US010297375B2

(12) United States Patent
Hirano et al.

(10) Patent No.: US 10,297,375 B2
(45) Date of Patent: May 21, 2019

(54) GRAIN-ORIENTED ELECTRICAL STEEL SHEET AND METHOD OF MANUFACTURING GRAIN-ORIENTED ELECTRICAL STEEL SHEET

(71) Applicant: NIPPON STEEL & SUMITOMO METAL CORPORATION, Tokyo (JP)

(72) Inventors: Koji Hirano, Kisarazu (JP); Yoshio Nakamura, Kitakyushu (JP); Shohji Nagano, Kitakyushu (JP); Seiichiro Cho, Kitakyushu (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 645 days.

(21) Appl. No.: 14/442,530

(22) PCT Filed: Nov. 6, 2013

(86) PCT No.: PCT/JP2013/080001
§ 371 (c)(1),
(2) Date: May 13, 2015

(87) PCT Pub. No.: WO2014/080763
PCT Pub. Date: May 30, 2014

(65) Prior Publication Data

US 2016/0284454 A1 Sep. 29, 2016

(30) Foreign Application Priority Data

Nov. 26, 2012 (JP) ..... 2012-257875

(51) Int. Cl.
*H01F 1/16* (2006.01)
*H01F 1/147* (2006.01)
(Continued)

(52) U.S. Cl.
CPC ..... *H01F 1/14783* (2013.01); *B22D 11/001* (2013.01); *C21D 8/1205* (2013.01);
(Continued)

(58) Field of Classification Search
CPC ..... C22C 38/04; C21D 9/46; C21D 8/1205; C21D 8/1222; H01F 1/14783; B22D 11/001
See application file for complete search history.

(56) References Cited

U.S. PATENT DOCUMENTS 3,856,568 A 12/1974 Tanaka
4,363,677 A * 12/1982 Ichiyama ..... C21D 1/09 148/111
(Continued)

FOREIGN PATENT DOCUMENTS

CN 1475583 2/2004
EP 0 577 124 A2 1/1994
(Continued)

OTHER PUBLICATIONS

Extended European Search Report dated Oct. 11, 2016, in European Patent Application No. 13857398.5.
(Continued)

*Primary Examiner* — Veronica F Faison
(74) *Attorney, Agent, or Firm* — Birch, Stewart, Kolasch & Birch, LLP

(57) ABSTRACT

A method of manufacturing a grain-oriented electrical steel sheet, includes: a laser processing process of forming a laser processed portion by irradiating a region on one end side of a steel sheet in a width direction after being subjected to a cold rolling process with a laser beam along a rolling direction of the steel sheet; and a finish annealing process of coiling the steel sheet with the laser processed portion formed thereon in a coil shape and performing a finish
(Continued)

annealing on the coil-shaped steel sheet. In the laser processing process, a melted-resolidified portion having a depth of greater than 0% and equal to or less than 80% of a sheet thickness of the steel sheet is formed by the irradiation of the laser beam at a position corresponding to the laser processed portion.

16 Claims, 11 Drawing Sheets

(51) Int. Cl.

| | |
|---|---|
| ***C21D 9/46*** | (2006.01) |
| ***C22C 38/00*** | (2006.01) |
| ***C22C 38/06*** | (2006.01) |
| ***C22C 38/02*** | (2006.01) |
| ***C22C 38/04*** | (2006.01) |
| ***B22D 11/00*** | (2006.01) |
| ***C21D 8/12*** | (2006.01) |
| ***C21D 10/00*** | (2006.01) |
| ***C23C 26/00*** | (2006.01) |

(52) U.S. Cl.

CPC ..... *C21D 8/1222* (2013.01); *C21D 8/1233* (2013.01); *C21D 8/1255* (2013.01); *C21D 8/1261* (2013.01); *C21D 8/1272* (2013.01); *C21D 8/1277* (2013.01); *C21D 8/1283* (2013.01); *C21D 8/1294* (2013.01); *C21D 9/46* (2013.01); *C21D 10/005* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C23C 26/00* (2013.01); *H01F 1/16* (2013.01)

(56) References Cited

U.S. PATENT DOCUMENTS

| | | | | |
|---|---|---|---|---|
| 4,863,531 | A * | 9/1989 | Wada | C21D 8/1294 148/111 |
| 2004/0040629 | A1 | 3/2004 | Hamamura et al. | |
| 2012/0028069 | A1 * | 2/2012 | Sakai | C21D 1/34 428/593 |
| 2013/0139932 | A1 * | 6/2013 | Sakai | C21D 8/1266 148/565 |
| 2014/0106130 | A1 * | 4/2014 | Sakai | C22C 38/02 428/157 |
| 2016/0284454 | A1 * | 9/2016 | Hirano | C21D 9/46 |

FOREIGN PATENT DOCUMENTS

| | | | | |
|---|---|---|---|---|
| JP | 48-039338 | | 6/1973 | |
| JP | 53-028375 | | 8/1978 | |
| JP | 63-100131 | | 5/1988 | |
| JP | 64-042530 | | 2/1989 | |
| JP | 02-097622 | | 4/1990 | |
| JP | 03-177518 | | 8/1991 | |
| JP | 06-065754 | | 3/1994 | |
| JP | 06-065755 | | 3/1994 | |
| JP | 2000-038616 | | 2/2000 | |
| JP | 2000-109961 | A | 4/2000 | |
| JP | 2001-323322 | | 11/2001 | |
| JP | 4029543 | B2 | 10/2007 | |
| RU | 2 345 148 | C2 | 1/2008 | |
| WO | 2010/103761 | | 9/2010 | |
| WO | WO 2012/014290 | A1 | 2/2012 | |
| WO | 2012033197 | | 3/2012 | |
| WO | WO-2012033197 | A1 * | 3/2012 | C21D 8/1266 |
| WO | 2012/165393 | | 12/2012 | |
| WO | WO-2012165393 | A1 * | 12/2012 | C22C 38/02 |

OTHER PUBLICATIONS

International Search Report dated Feb. 4, 2014 issued in corresponding PCT Application No. PCT/JP2013/080001 (with English language translation).

Office Action dated Feb. 26, 2016 issued in related Chinese Application No. 201380060271.X [with Partial English Translation].

Decision on Grant dated Jul. 12, 2016, in Russian Patent Application No. 2015119255, with English translation.

* cited by examiner

GRAIN-ORIENTED ELECTRICAL STEEL SHEET AND METHOD OF MANUFACTURING GRAIN-ORIENTED ELECTRICAL STEEL SHEET

TECHNICAL FIELD OF THE INVENTION

This application is a national stage application of International Application No. PCT/JP2013/080001, filed Nov. 6, 2013, which claims priority to Japanese Application No. 2012-257875, filed on Nov. 26, 2012, each of which is incorporated by reference in its entirety.

The present invention relates to a grain-oriented electrical steel sheet in which laser processing is performed on a region on one end side of a steel sheet in the width direction and a method of manufacturing a grain-oriented electrical steel sheet.

RELATED ART

The above-described grain-oriented electrical steel sheet is manufactured in the order of a hot rolling process, an annealing process, a cold rolling process, a decarburizing annealing process, a finish annealing process, a flattening annealing process, and an insulating coating forming process, by using a silicon steel slab as the material thereof.

Here, in the decarburizing annealing process before the finish annealing process, a $SiO_2$ coating containing silica ($SiO_2$) as a primary component is formed on the surface of the steel sheet. In addition, in the finish annealing process, the steel sheet is loaded into a batch type furnace in a state of being coiled in a coil shape, and is then subjected to a heat treatment. Here, in order to prevent the seizure of the steel sheet in the finish annealing process, an annealing separator containing magnesia (MgO) as a primary component is applied to the surface of the steel sheet before the finish annealing process. In the finish annealing process, the $SiO_2$ coating and the annealing separator containing magnesia as a primary component react with each other such that a glass coating is formed on the surface of the steel sheet.

Hereinafter, the finish annealing process will be described in detail. In the finish annealing process, as shown in FIG. 1, a coil 5 obtained by coiling the steel sheet is disposed on a coil receiving stand 8 in an annealing furnace cover 9 so that a coiling axis 5*a* of the coil 5 is coincident with the vertical direction.

When the coil 5 installed as described above is annealed at a high temperature, as shown in FIG. 2, a lower end portion 5*z* of the coil 5 which comes into contact with the coil receiving stand 8 is plastically deformed by its own weight, the difference in the coefficient of thermal expansion between the coil receiving stand 8 and the coil 5, and the like. The plastic deformation, which is generally called side strain deformation, cannot be completely removed later even by the flattening annealing process. In a case where the portion (side strain portion 5*e*) in which the side strain deformation occurs does not satisfy the requirements of customers, the side strain portion 5*e* is trimmed off.

Therefore, when the side strain portion 5*e* is increased in size, there is a problem in that the yield decreases due to an increase in the trimming width. As shown in FIG. 3, when the steel sheet which is uncoiled from the coil 5 in a plate shape is positioned on a flat surface plate, the side strain portion 5*e* is observed through the height h of a waveform which is formed in the end portion of the steel sheet from the surface of the surface plate. In general, the side strain portion 5*e* is a deformed region of the end portion of the steel sheet which satisfies the condition that the height h of the waveform is greater than 2 mm or the condition that a steepness s expressed by the following expression (1) is greater than 1.5% (more than 0.015).

$$s=h/Wg \quad (1)$$

where Wg is the width of the side strain portion 5*e*.

A mechanism for generating side strain deformation during the finish annealing is explained by grain boundary sliding at a high temperature. That is, deformation due to the grain boundary sliding becomes significant at a high temperature of 900° C. or higher, and thus the side strain deformation easily occurs at the grain boundary. In the lower end portion 5*z* of the coil 5 which comes into contact with the coil receiving stand 8, the growth time of secondary recrystallization is late compared to the center portion of the coil 5. Therefore, in the lower end portion 5*z* of the coil 5, the grain size is small, and thus a refined portion is easily formed.

It is speculated that since many grain boundaries are present in the refined portion, grain boundary sliding as described above easily occurs and the side strain deformation occurs. Therefore, in the related art, various methods of suppressing mechanical deformation by suppressing the grain growth of the lower end portion 5*z* of the coil 5 are proposed.

In Patent Document 1 described below, a method of applying a grain refining agent to a band-like portion having a constant width from the lower end surface of a coil that comes into contact with a coil receiving stand before finish annealing and refining the band-like portion during the finish annealing is disclosed. In addition, in Patent Document 2 described below, a method of imparting processing deformation strain to a band-like portion having a constant width from the lower end surface of a coil that comes into contact with a coil receiving stand before finish annealing using a roll with a protrusion attached thereto and refining the band-like portion during the finish annealing is disclosed.

As described above, in the methods disclosed in Patent Documents 1 and 2, in order to suppress side strain deformation, the mechanical strength of the lower end portion of the coil is changed by intentionally refining the grains of the lower end portion of the coil.

However, in the method disclosed in Patent Document 1, since the grain refining agent is liquid, accurate control of an application region is difficult. In addition, there may be a case where the grain refining agent may diffuse toward the center portion of the steel sheet from the end portion of the steel sheet. As a result, the width of a refined region cannot be controlled to be constant, and thus the width of a side strain portion is significantly changed in the longitudinal direction of the coil. The width of the side strain portion which is most significantly deformed is set as a trimming width. Therefore, in a case where the width of the side strain portion is large at least at a single point, the trimming width is increased, resulting in a reduction in the yield.

In addition, in the method disclosed in Patent Document 2, the grains of the lower end portion of the coil are refined with respect to the strain caused by the machining using the roll or the like as the starting point. However, the roll wears due to the continuous processing over a long period of time, and thus there is a problem in that the imparted processing deformation strain (rolling reduction) decreases with time and a refining effect is reduced. Particularly, since the grain-oriented electrical steel sheet is a hard material containing a large amount of Si, the severe wear of the roll occurs, and thus the roll needs to be frequently replaced. In addition, the machining imparts strain over a wide range, and thus there is a limit to the suppression range of the side strain deformation.

In addition, in Patent Documents 3 to 6 described below, in order to suppress side strain deformation, a method of enhancing high temperature strength by accelerating secondary recrystallization of a band-like portion having a constant width from the lower end of a coil so as to increase the grain size at an early stage of finish annealing is disclosed.

In Patent Documents 3 and 4, as means of increasing the grain size, a method of heating the band-like portion of the end portion of a steel sheet through plasma heating or induction heating before finish annealing is disclosed. In addition, in Patent Documents 3, 5, and 6, a method of introducing machining strain by shot blasting, a roll, a roll with teeth, and the like is disclosed.

The plasma heating and the induction heating are heating types with a relatively wide heating range, and is thus appropriate for heating a band-like range. However, there is a problem in that it is difficult to control a heating position or a heating temperature during the plasma heating and the induction heating. In addition, there is a problem in that a wider region than a predetermined range is heated due to heat conduction. Therefore, the width of the region in which the grain size is increased by secondary recrystallization cannot be controlled to be constant, and thus there is a problem in that an effect of suppressing the side strain deformation is less likely to be uniform.

In the method by the machining using the roll or the like, as described above, there is a problem in that an effect of imparting strain (strain amount) is reduced with time due to the wear of the roll. Particularly, the rate of secondary recrystallization is minutely changed depending on the strain amount, and thus there is a problem in that even when the strain amount due to the wear of the roll is small, a desired grain size cannot be obtained and the effect of suppressing the side strain deformation cannot be stably obtained. In addition, since the machining imparts strain over a wide range, there is a limit to the suppression range of the side strain deformation.

As described above, in the methods disclosed in Patent Documents 1 to 6, it is difficult to perform accurate control of the grain size (range and size), and thus there is a problem in that the effect of suppressing the side strain deformation cannot be sufficiently obtained.

Here, in Patent Document 7 described below, a technique of forming an easily deformable portion or a groove portion that extends parallel to the rolling direction in a region on one end side of a steel sheet in the width direction by irradiation of a laser beam, water jetting, or the like is proposed. In this case, the propagation of the side strain is prevented by the easily deformable portion or the groove portion formed in the region on one end side of the steel sheet in the width direction, and the width of the side strain portion can be reduced.

PRIOR ART DOCUMENT

Patent Document

[Patent Document 1] Japanese Unexamined Patent Application, First Publication No. S63-100131

[Patent Document 2] Japanese Unexamined Patent Application, First Publication No. S64-042530

[Patent Document 3] Japanese Unexamined Patent Application, First Publication No. H02-097622

[Patent Document 4] Japanese Unexamined Patent Application, First Publication No. H03-177518

[Patent Document 5] Japanese Unexamined Patent Application, First Publication No. 2000-038616

[Patent Document 6] Japanese Unexamined Patent Application, First Publication No. 2001-323322

[Patent Document 7] PCT International Publication No. WO2010/103761

DISCLOSURE OF THE INVENTION

Problems to be Solved by the Invention

However, in the method of forming a grain boundary sliding deformation portion disclosed in Patent Document 7, the easily deformable portion is formed in a base iron portion of the steel sheet itself. The easily deformable portion is a region having a straight line shape including grain boundaries formed in the base iron portion of the steel sheet during finish annealing or a sliding band including grains formed in the base iron portion of the steel sheet. The easily deformable portion is formed in a portion (heat affected zone) where a heat effect is applied to the base iron portion by irradiating the surface of the steel sheet with a laser beam before the finish annealing. In the method disclosed in Patent Document 7, the heat affected zone is a portion (melted-resolidified portion) which is melted due to the heat of the laser beam and is then resolidified, and the melted-resolidified portion is formed over the entire sheet thickness. Due to the heat effect, in the easily deformable portion generated during the finish annealing, abnormal grains in which the directions of the magnetization easy axes are deviated from the rolling direction of the steel sheet are generated at a high ratio. Therefore, in the base iron portion of the region in which the easily deformable portion is formed, magnetic properties are deteriorated.

Here, when the width of the side strain portion is suppressed to be small as described above and thus satisfies the requirements of customers, there may be a case where trimming of the side strain portion may not be performed. However, in the present invention disclosed in Patent Document 7, even in a case where the side strain portion is allowed, there is a problem in that the magnetic properties in the portion in which the easily deformable portion or the groove portion is formed are deteriorated and thus the quality of the grain-oriented electrical steel sheet is degraded.

Furthermore, in order to form the easily deformable portion or the groove portion in the steel sheet, high energy needs to be applied to the steel sheet. Accordingly, a pretreatment performed before the finish annealing takes a long time or a large high-output laser device is necessary, and thus there is a problem in that the grain-oriented electrical steel sheet cannot be efficiently manufactured.

The present invention has been made taking the foregoing circumstances into consideration, and an object thereof is to provide a grain-oriented electrical steel sheet having excellent magnetic properties while side strain deformation is minimized and a method of manufacturing the same.

Means for Solving the Problem

In order to accomplish the object for solving the problems, the present invention employs the following means.

(1) A grain-oriented electrical steel sheet according to an aspect of the present invention is a grain-oriented electrical steel sheet which is manufactured by irradiating a region on one end side of a steel sheet in a width direction after being subjected to a cold rolling process with a laser beam along a rolling direction of the steel sheet and thereafter performing a finish annealing on the steel sheet which is coiled in a coil shape, in which, regarding grains in a base iron portion of the steel sheet, which are positioned at a lower portion of a laser irradiation mark formed on a surface of the steel sheet by the irradiation of the laser beam, an angular deviation amount θa between a direction of a magnetization easy axis of each of the grains and the rolling direction is defined, and an average value R of the angular deviation amounts θa obtained by averaging the angular deviation amounts θa of the grains by the grains positioned at the lower portion of the laser irradiation mark is higher than 20° and equal to or less 40°.

(2) In the grain-oriented electrical steel sheet described in (1), a distance WL from one end of the steel sheet in the width direction to a center of the laser irradiation mark in the width direction may be 5 mm to 35 mm.

(3) In the grain-oriented electrical steel sheet described in (1) or (2), the laser irradiation mark may be formed in a region of 20% to 100% of an entire length of the steel sheet in the rolling direction from a starting point which is one end of the steel sheet in the rolling direction positioned in an outermost circumference of the steel sheet coiled in a coil shape.

(4) In the grain-oriented electrical steel sheet described in any one of (1) to (3), a width d of the laser irradiation mark may be 0.05 mm to 5.0 mm.

(5) A method of manufacturing a grain-oriented electrical steel sheet according to an aspect of the present invention, includes: a laser processing process of forming a laser processed portion by irradiating a region on one end side of a steel sheet in a width direction after being subjected to a cold rolling process with a laser beam along a rolling direction of the steel sheet; and a finish annealing process of coiling the steel sheet with the laser processed portion formed thereon in a coil shape and performing a finish annealing on the coil-shaped steel sheet, in which in the laser processing process, a melted-resolidified portion having a depth of greater than 0% and equal to or less than 80% of a sheet thickness of the steel sheet is formed by the irradiation of the laser beam at a position corresponding to the laser processed portion.

(6) in the method of manufacturing a grain-oriented electrical steel sheet described in (5), a distance WL from one end of the steel sheet in the width direction to a center of the laser processed portion in the width direction may be 5 mm to 35 mm.

(7) in the method of manufacturing a grain-oriented electrical steel sheet described in (5) or (6), in the laser processing process, the laser processed portion may be formed in a region of 20% to 100% of an entire length of the steel sheet in the rolling direction from a starting point which is one end of the steel sheet in the rolling direction positioned in an outermost circumference of the steel sheet coiled in a coil shape in the finish annealing process.

(8) In the method of manufacturing a grain-oriented electrical steel sheet described in any one of (5) to (7), a width d of the laser processed portion may be 0.05 mm to 5.0 mm.

According to the method of manufacturing a grain-oriented electrical steel sheet described above, in the laser processing process, the melted-resolidified portion having a depth of greater than 0% and equal to or less than 80% of the sheet thickness of the steel sheet is formed on the steel sheet. Accordingly, the melted-resolidified portion is altered when the finish annealing is performed on the steel sheet coiled in the coil shape in the finish annealing process, and thus the average value R of the angular deviation amounts θa between the directions of the magnetization easy axes of the grains of the melted-resolidified portion and the rolling direction is higher than 20° and equal to or less than 40°. Therefore, by the manufacturing method, a grain-oriented electrical steel sheet in which the average value R of the angular deviation amounts θa of the grains positioned at the lower portion of the laser irradiation mark is higher than 20° and equal to or less 40° can be appropriately manufactured.

Effects of the Invention

According to the above-described aspects, since the side end portion of the grain-oriented electrical steel sheet after the cold rolling process and before the finish annealing process is irradiated with the laser beam, side strain deformation which occurs in the finish annealing process can be suppressed. In addition, the average value R of the angular deviation amounts θa between the directions of the magnetization easy axes of the grains at the lower portion of the laser irradiation mark corresponding to the melted-resolidified portion formed in the steel sheet by the irradiation of the laser beam and the rolling direction is in a range of higher than 20° and equal to or less than 40°. Therefore, magnetic properties in the portion subjected to the laser processing are improved, and the portion can also be used as a material such as a transformer depending on the case, thereby realizing the enhancement of the yield.

Accordingly, according to the above-described aspects, a grain-oriented electrical steel sheet having excellent magnetic properties while side strain deformation is minimized, and a method of manufacturing the same can be provided.

EMBODIMENT OF THE INVENTION

Figure 1:
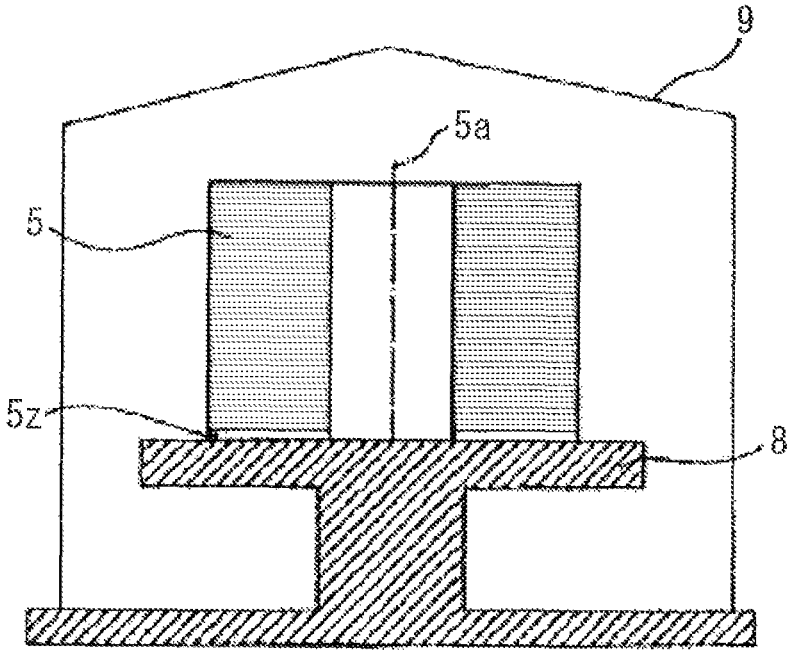
FIG. 1 is an explanatory view showing an example of a finish annealing apparatus.
Figure 2:
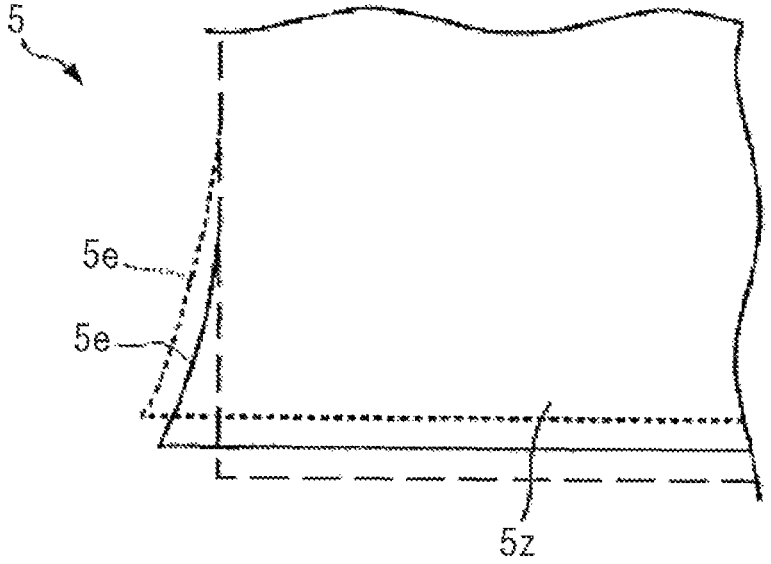
FIG. 2 is a schematic view showing a growth procedure of side strain in a coil of the related art in which means for suppressing side strain deformation is not devised.
Figure 3:
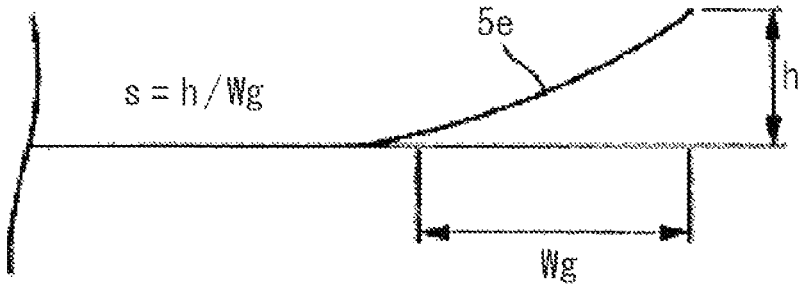
FIG. 3 is an explanatory view showing an example of an evaluation method of the side strain deformation.

Hereinafter, a grain-oriented electrical steel sheet according to an embodiment of the present invention and a method of manufacturing a grain-oriented electrical steel sheet will be described in detail with reference to the accompanying drawings. In the specification and the drawings, like elements having substantially the same functional configurations are denoted by like reference numerals, and a redundant description will be omitted. In addition, the present invention is not limited to the following embodiment.

First, a method of manufacturing a grain-oriented electrical steel sheet 10 according to this embodiment will be described.

Figure 6:
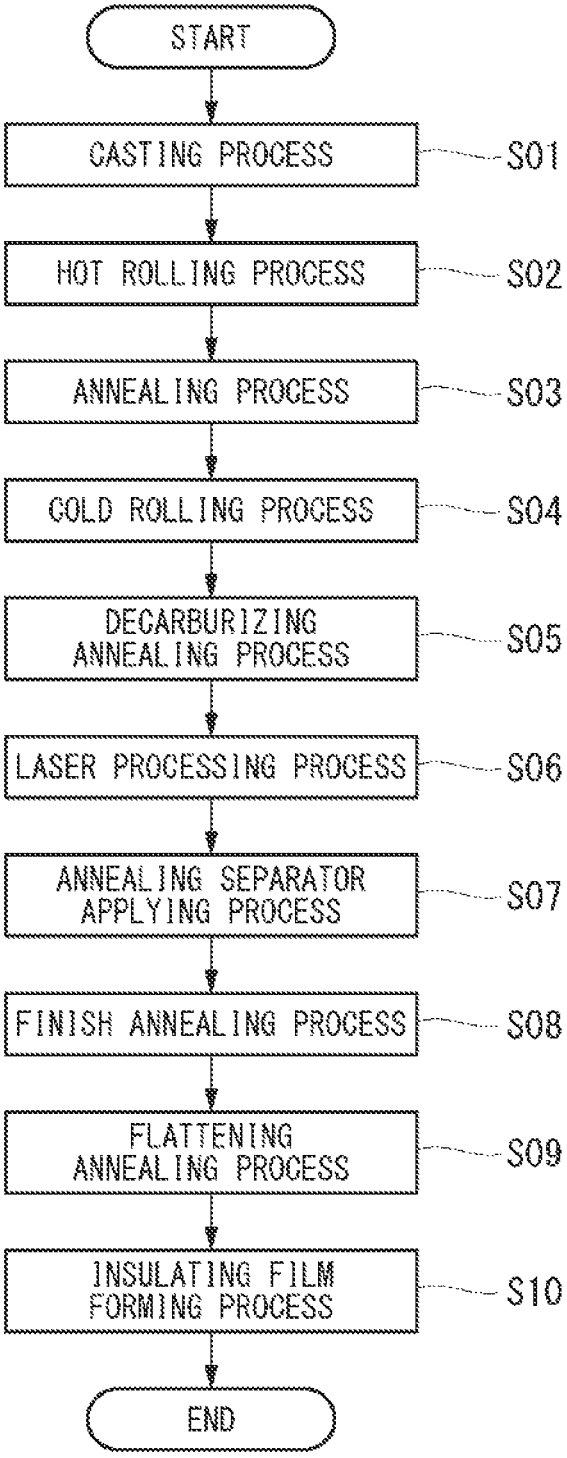
FIG. 6 is a flowchart showing a method of manufacturing the grain-oriented electrical steel sheet according to the embodiment of the present invention.

As shown in the flowchart of FIG. 6, the method of manufacturing the grain-oriented electrical steel sheet 10 according to this embodiment includes a casting process S01, a hot rolling process S02, an annealing process S03, a cold rolling process S04, a decarburizing annealing process S05, a laser processing process S06, an annealing separator applying process S07, a finish annealing process S08, a flattening annealing process S09, and an insulating coating forming process S10.

In the casting process S01, a molten steel produced to have a predetermined composition is supplied to a continuous casting machine to continuously produce a casting. As the composition of the molten steel, an iron alloy containing Si, which is generally used as a material of the grain-oriented electrical steel sheet 10, is used. In this embodiment, for example, a molten steel having the following composition is used:

Si: 2.5 mass % to 4.0 mass %;
C: 0.02 mass % to 0.10 mass %;
Mn: 0.05 mass % to 0.20 mass %;
acid-soluble Al: 0.020 mass % to 0.040 mass %;
N: 0.002 mass % to 0.012 mass %;
S: 0.001 mass % to 0.010 mass %;
P: 0.01 mass % to 0.04 mass %; and
the remainder: Fe and an impurity.

In the hot rolling process S02, the casting obtained in the casting process S01 is heated to a predetermined temperature (for example, 1150 to 1400° C.), and is subjected to hot rolling. Accordingly, for example, a hot-rolled material having a thickness of 1.8 to 3.5 mm is produced.

In the annealing process S03, a heat treatment is performed on the hot-rolled material obtained in the hot rolling process S02, for example, under the condition of an annealing temperature of 750 to 1200° C. and an annealing time of 30 seconds to 10 minutes.

In the cold rolling process S04, the surface of the hot-rolled material after being subjected to the annealing process S03 is pickled, and is then subjected to cold rolling. Accordingly, for example, a steel sheet 11 having a thickness of 0.15 to 0.35 mm is produced.

In the decarburizing annealing process S05, a heat treatment is performed on the steel sheet 11 obtained in the cold rolling process S04, for example, under the condition of an annealing temperature of 700 to 900° C. and an annealing time of 1 to 3 minutes. In addition, in this embodiment, as shown in FIG. 7, the heat treatment is performed by allowing the steel sheet 11 to pass through a decarburizing annealing furnace 31 while the steel sheet 11 travels.

In the decarburizing annealing process S05, a $SiO_2$ coating containing silica ($SiO_2$) as a primary component is formed on the surface of the steel sheet 11.

Figure 9:
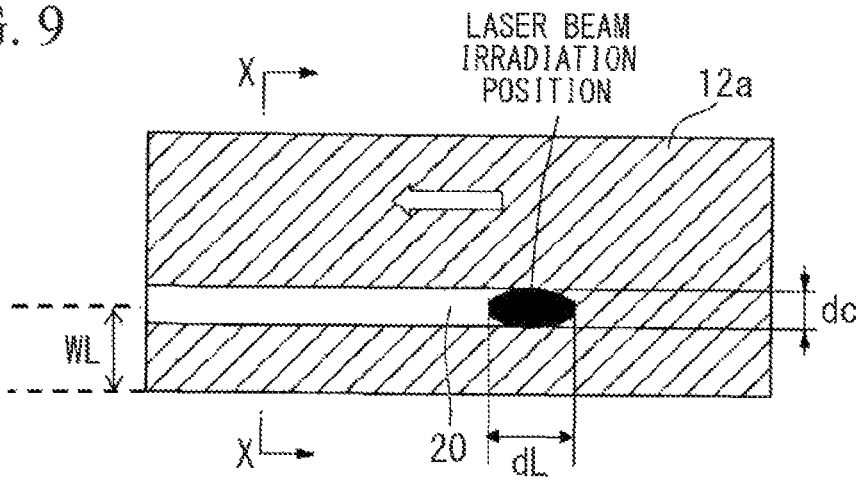
FIG. 9 is a schematic explanatory view of a steel sheet on which the laser processing process is performed.

In the laser processing process S06, as shown in FIG. 9, a region on one end side of the steel sheet 11 in the width direction where the $SiO_2$ coating 12*a* is formed is irradiated with a laser beam along the rolling direction under the laser irradiation conditions, which will be described below in detail, thereby forming a laser processed portion 20. The laser processed portion 20 is recognized on the surface of the steel sheet 11 as a laser irradiation mark 14 after the finish annealing process S08. In addition, both sides of the steel sheet 11 may be irradiated with the laser beam in order to form the laser processed portion 20 on both sides of the steel sheet 11.

Figure 7:
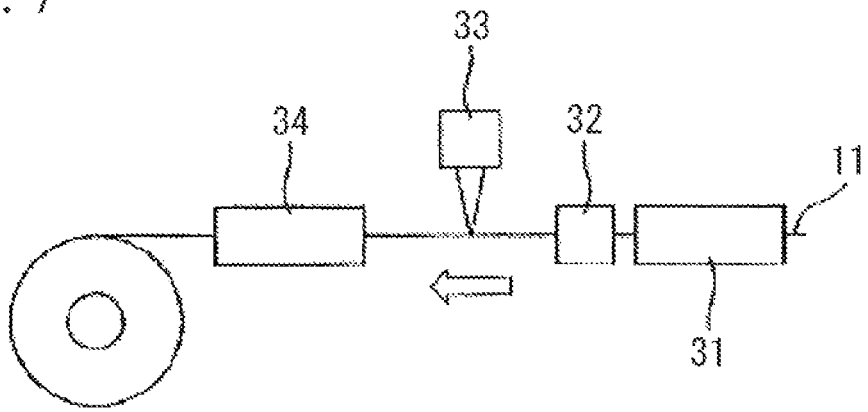
FIG. 7 is a schematic explanatory view of facilities for performing a decarburizing annealing process, a laser processing process, and an annealing separator applying process.

As shown in FIG. 7, the laser processing process S06 is performed by a laser processing device 33 provided on the rear stage side of the decarburizing annealing furnace 31. In addition, a cooling device 32 which cools the steel sheet 11 after the decarburizing annealing process S05 may be disposed between the decarburizing annealing furnace 31 and the laser processing device 33. Through the cooling device 32, the temperature T of the steel sheet 11 transported to the laser processing device 33 can be set to be in a range of higher than 0° C. and equal to or less than 300° C.

The laser processing process may be provided between the cold rolling process S04 and the decarburizing annealing process S05 or between the annealing separator applying process S07 and the finish annealing process S08. Hereinafter, as shown in the flowchart of FIG. 6, the embodiment in which the laser processing process S06 is provided between the decarburizing annealing process S05 and the annealing separator applying process S07 will be described.

Figure 8:
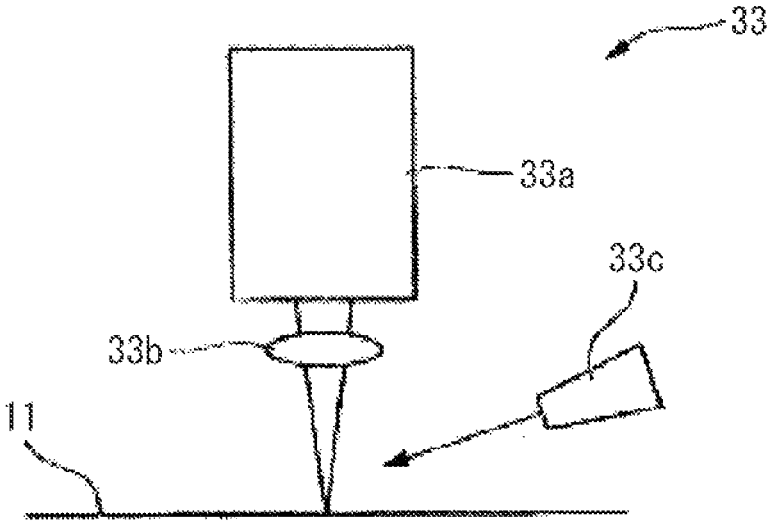
FIG. 8 is a schematic explanatory view of a laser processing device which performs the laser processing process.

Hereinafter, the laser processing process S06 will be described. As shown in FIG. 8, the laser processing device 33 includes a laser oscillator 33*a*, a condenser lens 33*b*, and a gas nozzle 33*c* which ejects assist gas toward the vicinity of a laser irradiation point. As the assist gas, air or nitrogen may be used. The light source and the type of the laser used are not particularly limited.

Figure 10:
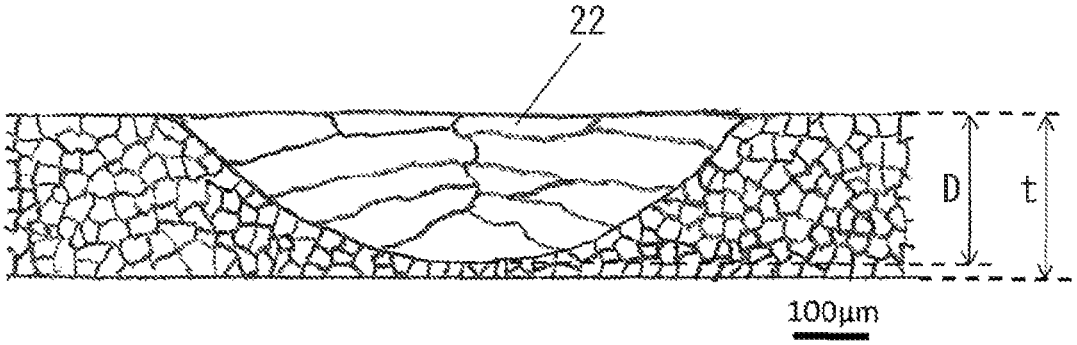
FIG. 10 is a schematic view showing a state of grains in the cross-section of the steel sheet in the width direction.

In this embodiment, the irradiation condition of the laser beam is set such that the depth D of a melted-resolidified portion 22 which is exhibited by a heat effect on the steel sheet 11 is greater than 0% and equal to or less than 80% of the sheet thickness t of the steel sheet 11. In FIG. 10, a schematic view of the structure in the laser processed portion 20 viewed when the cross-section of the steel sheet 11 in the width direction is observed is shown.

As shown in FIG. 10, the melted-resolidified portion 22 is a portion in which the steel sheet 11 is melted due to the heat of the laser beam and is thereafter resolidified. The melted-resolidified portion 22 is heat-affected by the irradiation of the laser beam, and thus the structure of the steel sheet 11 is coarsened. Here, the depth D of the melted-resolidified portion 22 is the depth of a region in the sheet thickness direction, where a coarser structure than that of a portion that is not heat-affected is present. The irradiation condition of the laser beam will be described later. In this embodiment, the irradiation condition of the laser beam is set such that the depth D of a melted-resolidified portion 22 is greater than 0% and equal to or less than 80% of the sheet thickness t. Accordingly, the width Wg (hereinafter, referred to as a side strain width Wg) of a side strain portion 5*e* of the steel sheet 11 which is generated in the finish annealing process S08 can be reduced. In addition, under the irradiation condition of the laser beam described above, in a portion of the steel sheet 11 positioned at the lower portion of the laser processed portion 20, the average value R of the angular deviation amounts θa between the directions of the magnetization easy axes of grains and the rolling direction is in a range of higher than 20° and equal to or less than 40°.

Here, the ratio obtained by dividing the depth D of the melted-resolidified portion 22 by the sheet thickness t of the steel sheet 11 is defined as q (=D/t). In this embodiment, the irradiation condition of the laser beam is set such that q is higher than 0 and equal to or less than 0.8.

A case in which the laser irradiation conditions such as the light source and the type of the laser, the laser beam diameter de (mm) of the steel sheet 11 in the width direction, the laser beam diameter dL (mm) of the steel sheet 11 in the sheet travelling direction (the longitudinal direction or the rolling direction), the sheet threading speed VL (mm/sec) of the steel sheet 11, the sheet thickness t (mm) of the steel sheet, the flow rate Gf (L/min) of the assist gas, and the like are given is considered. In this case, when the laser power P (W) is gradually increased from zero while all of the conditions are fixed, the threshold of the laser power P at which melting occurs on the surface of the base iron portion of the steel sheet 11 is assumed to be P0 (W). In addition, when the laser power P is increased, a power P at which q is 0.8 is assumed to be P0' (W).

Under the above-described conditions, in the laser processing process S06, it is desirable that the steel sheet 11 is irradiated with the laser beam by setting the laser power P to satisfy P0≤P<P0'. Accordingly, through the irradiation of the laser beam, the melted-resolidified portion 22 can be formed in the base iron portion immediately below the laser irradiation position of the steel sheet 11, and the ratio q of the depth D of the melted-resolidified portion 22 to the sheet thickness t can be higher than 0 and equal to or less than 0.8. That is, the melted-resolidified portion 22 having a depth D of greater than 0% and equal to or less than 80% of the sheet thickness t of the steel sheet 11 can be formed.

The inventors repeatedly, intensively studied, and as a result, found that the depth D of the melted-resolidified portion 22 (hereinafter, sometimes referred to as "melted-resolidified portion depth D") can be greater than 0% and equal to or less than 80% of the sheet thickness t (that is, 0≤q≤0.8) by setting the irradiation condition of the laser beam as follows. These expressions are obtained by correcting the estimation expressions of the melted-resolidified portion depth D, which are obtained by analyzing a heat conduction phenomenon during the laser beam irradiation, using experimental measurement results of the melted-resolidified portion depth D under various laser conditions. That is, regarding the irradiation of the laser beam, when the sheet threading speed VL (mm/sec) of the steel sheet 11 and the sheet thickness t (mm) of the steel sheet 11 are given, the output (laser power) P(W) of the laser beam, the laser beam diameter dc (mm) of the steel sheet 11 in the width direction, and the laser beam diameter dL (mm) of the steel sheet 11 in the sheet travelling direction are adjusted to satisfy the following expressions (1) and (2).

$$P1<P<P2 \tag{1}$$

$$0.2\ \text{mm} \le dc \le 5.0\ \text{mm} \tag{2}$$

Here, P1 and P2 in the expression (I) are obtained by the following expressions (3) to (5). In addition, the definitions of dc and dL are shown in FIG. 9.

[Formula 1]

$$P1(W) = 3(d_c + d_b)\cdot d_h \cdot VL \tag{3}$$

$$P2(W) = \frac{31}{1+1.3\sqrt{d_c}}(d_c + d_h)\cdot t \cdot VL \tag{4}$$

$$d_h(\text{mm}) = 4.8\sqrt{\frac{dL}{VL}} \tag{5}$$

Figure 5:
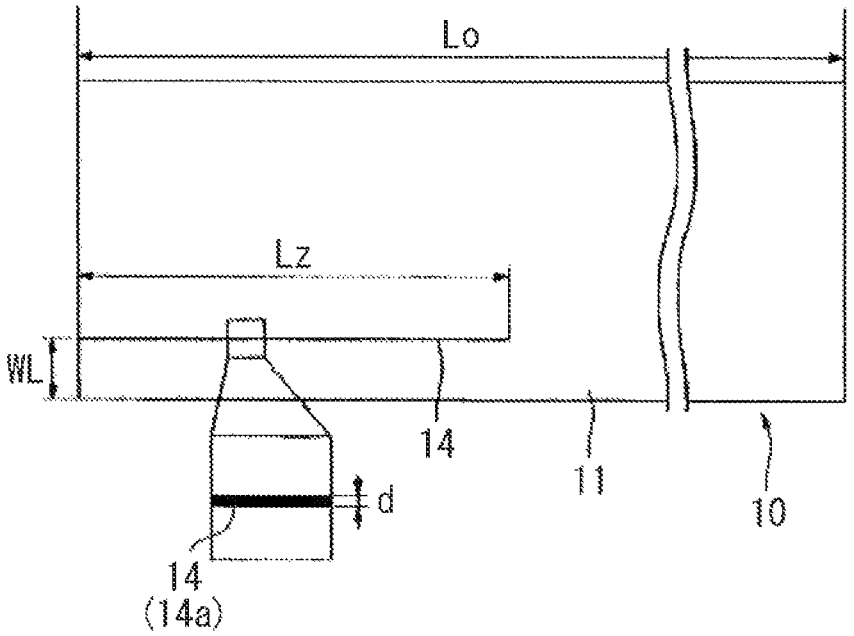
FIG. 5 is an explanatory view showing the grain-oriented electrical steel sheet according to the embodiment of the present invention.

In order to reliably suppress the propagation of the side strain portion 5*e* due to the laser processed portion 20, it is desirable that the irradiation position of the laser beam in the steel sheet width direction is adjusted such that the distance WL (corresponding to "the distance WL from one end of the steel sheet 11 in the width direction to the center of the laser irradiation mark 14 in the width direction" shown in FIG. 5) from one end of the steel sheet 11 in the width direction to the irradiation position (the center of the laser processed portion 20 in the width direction) is in a range of 5 mm to 35 mm. In addition, it is desirable that the rolling direction length Lz (corresponding to "the rolling direction length Lz of the laser irradiation mark 14" shown in FIG. 5) of the laser processed portion 20 is 20% to 100% of the entire length Lc of a coil 5 from the starting point which is the outermost circumferential portion of the coil 5. Accordingly, even in the outer circumferential side portion of the coil 5 where side strain deformation easily occurs, the propagation of the side strain deformation can be reliably suppressed.

Furthermore, it is desirable that the width d of the laser processed portion 20 (the laser irradiation mark 14) corresponding to the beam diameter dc of the laser beam in the steel sheet width direction is in a range of 0.05 mm to 5.0 mm. The effect of the width d of the laser processed portion 20 on the degree of propagation of the side strain deformation is not significant. However, in a case where the width d of the laser processed portion 20 is less than 0.05 mm, there is a problem in that thermal diffusion directed toward the steel sheet 11 during the laser irradiation becomes significant and thus energy efficiency is reduced. In addition, in a case where the width d of the laser processed portion 20 is greater than 5 mm, there is a problem in that the required laser output is too high.

In the annealing separator applying process S07 subsequent to the laser processing process S06, an annealing separator containing magnesia (MgO) as a primary component is applied onto the $SiO_2$ coating 12*a*, and the resultant is heated and dried. In addition, in this embodiment, as shown in FIG. 7, an annealing separator applying device 34 is disposed on the rear stage side of the laser processing device 33, and continuously applies the annealing separator to the surface of the steel sheet 11 subjected to the laser processing process S06.

In addition, the steel sheet 11 which passes through the annealing separator applying device 34 is coiled in a coil shape, thereby obtaining the coil 5. In addition, the outermost circumferential end of the coil 5 becomes the rear end of the steel sheet 11 which passes through the decarburizing annealing furnace 31, the laser processing device 33, and the annealing separator applying device 34. Here, in this embodiment, in the laser processing process S06, the laser processed portion 20 is formed at least in a region on the rear end side of the steel sheet 11.

Figure 11:
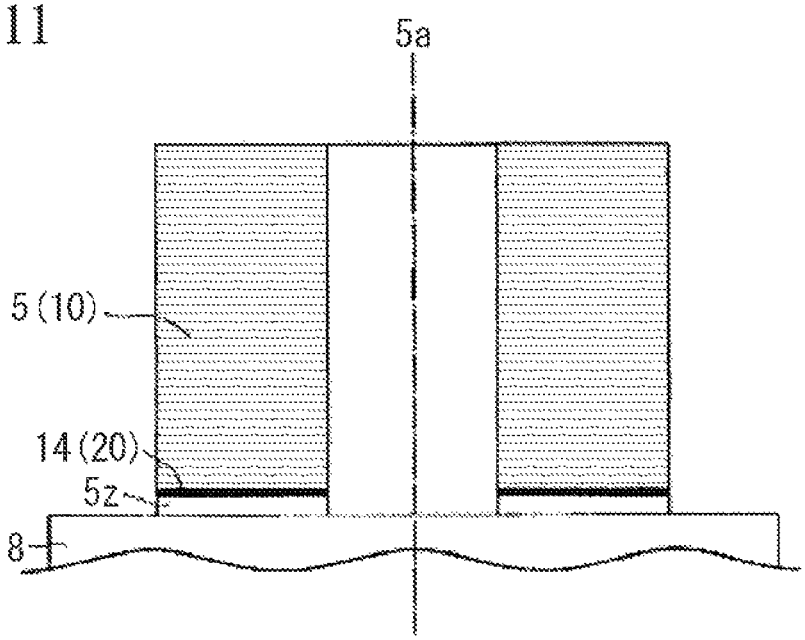
FIG. 11 is an explanatory view showing a state where the grain-oriented electrical steel sheet according to the embodiment of the present invention is coiled in a coil shape.

Next, in the finish annealing process S08, as shown in FIG. 11, the coil 5 obtained by coiling the steel sheet 11 to which the annealing separator is applied is placed on a coil receiving stand 8 so that a coiling axis 5*a* is directed in the vertical direction, and is loaded into a finish annealing furnace to be subjected to a heat treatment (batch type finish annealing). In addition, the heat treatment conditions in the finish annealing process S08 are set such that, for example, the annealing temperature is 1100 to 1300° C. and the annealing time is 20 to 24 hours.

In the finish annealing process S08, as shown in FIG. 11, the coil 5 is placed on the coil receiving stand 8 so that a portion on one end side of the coil 5 (steel sheet 11) in the width direction (lower end side of the coil 5 in the axial direction), in which the laser processed portion 20 is formed, comes into contact with the coil receiving stand 8.

Figure 12:
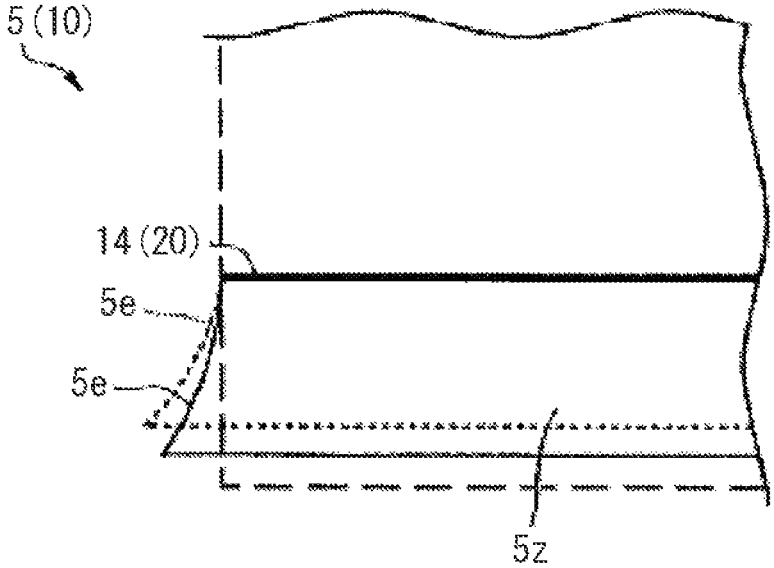
FIG. 12 is a schematic view showing a growth procedure of side strain deformation in the grain-oriented electrical steel sheet according to the embodiment of the present invention.

In the finish annealing process S08, in a case where a load is applied to the coil 5 due to its own weight and the like, the laser processed portion 20 is first deformed. As shown in FIG. 12, although the side strain portion 5*e* propagates from the contact position (one end side of the coil 5 in the width direction) of the coil 5 and the coil receiving stand 8 toward the other end side in the width direction, the propagation of the side strain portion 5*e* is suppressed by the laser processed portion 20. Therefore, the width (the side strain width Wg) of the side strain portion 5*e* is reduced, and thus a trimming width can be reduced even in a case of removing the side strain portion 5*e*. Accordingly, the manufacturing yield of the grain-oriented electrical steel sheet 10 can be enhanced.

In addition, in the finish annealing process S08, the $SiO_2$ coating 12*a* containing silica as a primary component and the annealing separator containing magnesia as a primary component react with each other, and thus a glass coating 12 (see FIG. 4) formed of forsterite ($Mg_2SiO_4$) is formed on the surface of the steel sheet 11.

In this embodiment, in the laser processing process provided before the finish annealing, the melted-resolidified portion 22 is formed in the steel sheet 11 by the irradiation of the laser beam, and the irradiated laser beam has a relatively low intensity (the above-mentioned laser power P) such that the ratio q of the depth D of the melted-resolidified portion 22 to the sheet thickness t is higher than 0 and equal to or less than 0.8 (higher than 0% and equal to or less than 80%). Due to the formation of the limited heat affected zone (the melted-resolidified portion 22), the laser processed portion 20 has a lower mechanical strength than that of the other portions, and is thus easily deformed. As a result, in the finish annealing process, it is speculated that the propagation of the side strain portion 5*e* is suppressed by the local deformation of the laser processed portion 20.

In the flattening annealing process S09 and the insulating coating forming process S10, the steel sheet 11 coiled in a coil shape is uncoiled and is stretched into a sheet shape by applying tension thereto at an annealing temperature of about 800° C. in order to be transported, and the coiling deformation of the coil 5 is released and flattened. At the same time, an insulating agent is applied onto the glass coatings 12 formed on both surfaces of the steel sheet 11 and is fused thereto, thereby forming the insulating coatings 13.

Figure 4:
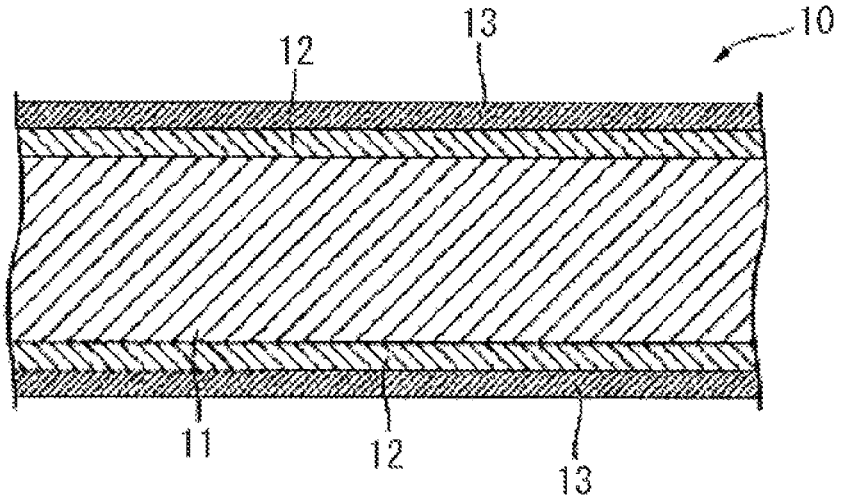
FIG. 4 is a cross-sectional view of a grain-oriented electrical steel sheet according to an embodiment of the present invention.

In this manner, the glass coating 12 and the insulating coating 13 are formed on the surface of the steel sheet 11, and thus the grain-oriented electrical steel sheet 10 according to this embodiment is manufactured (see FIG. 4). Furthermore, after the insulating coating forming process S10, magnetic domain control may be performed by irradiating one surface of the grain-oriented electrical steel sheet 10 with the laser beam to be condensed thereon and periodically imparting linear strain in a direction substantially perpendicular to the rolling direction and in the rolling direction.

According to the method of manufacturing the grain-oriented electrical steel sheet 10 of this embodiment, the side strain width Wg and the warpage of the side strain portion 5*e* can be sufficiently suppressed. Therefore, in a case where the manufactured grain-oriented electrical steel sheet 10 satisfies the requirements of customers even with the side strain portion 5*e*, the side strain portion 5*e* may not be trimmed off. In this case, the manufacturing yield of the grain-oriented electrical steel sheet 10 can be further enhanced.

In this embodiment, as described above, the ratio q of the depth D of the melted-resolidified portion 22 formed by the irradiation of the laser beam to the sheet thickness t is greater than 0% and equal to or less than 80% (higher than 0 and equal to or less than 0.8). As a result, as described later in detail, regarding the grains positioned at the lower portion of the laser irradiation mark 14 (on the inside of the steel sheet 11 in the sheet thickness direction) in the base iron portion of the steel sheet 11 obtained after the finish annealing process S08, the average value R of the angular deviation amounts θa between the directions of the magnetization easy axes of the grains and the rolling direction can be suppressed to be in a range of higher than 20° and equal to or less than 40°. Accordingly even in a case where the trimming of the side strain portion 5*e* is not performed, the grain-oriented electrical steel sheet 10 can be used as a product having excellent magnetic properties as it is depending on the usage, and thus both the quality and the product yield of the grain-oriented electrical steel sheet 10 can be enhanced.

Therefore, even in a case where the side strain width Wg of the side strain portion 5*e* is small and the side strain portion 5*e* does not need to be removed, the grain orientations of the base iron portion on the inside of the laser irradiation mark 14 are highly stabilized compared to those of the related art, and thus the grain-oriented electrical steel sheet 10 can be used as it depends on the usage.

In addition, since the power P of the laser beam in the laser processing process S06 can be suppressed to be low, a large high-output laser device is unnecessary, and thus the grain-oriented electrical steel sheet 10 can be efficiently manufactured.

Next, the grain-oriented electrical steel sheet 11 according to this embodiment will be described. As shown in FIG. 4, the grain-oriented electrical steel sheet 10 according to this embodiment includes the steel sheet 11, the glass coatings 12 formed on the surfaces of the steel sheet 11, and the insulating coatings 13 formed on the glass coatings 12.

The steel sheet 11 is formed of an iron alloy containing Si, which is generally used as a material of the grain-oriented electrical steel sheet 10. The steel sheet 11 according to this embodiment has, for example, the following composition:

Si: 2.5 mass % to 4.0 mass %;
C: 0.02 mass % to 0.10 mass %;
Mn: 0.05 mass % to 0.20 mass %;
acid-soluble Al: 0.020 mass % to 0.040 mass %
N: 0.002 mass % to 0.012 mass %;
S: 0.001 mass % to 0.010 mass %;
P: 0.01 mass % to 0.04 mass %; and
the remainder: Fe and an impurity.

The thickness of the steel sheet 11 is generally 0.15 mm to 0.35 mm, but may also be out of this range.

The glass coating 12 is, for example, formed of a complex oxide such as forsterite ($Mg_2SiO_4$), spinel ($MgAl_2O_4$), or cordierite ($Mg_2Al_4Si_5O_{16}$). In addition, the thickness of the glass coating 12 in a portion excluding the laser irradiation mark 14 corresponding to the laser processed portion 20 is, for example, generally 0.5 μm to 3 μm, and particularly about 1 μm, but is not limited to this example.

The insulating coating 13 is formed of a coating liquid (for example, refer to Japanese Unexamined Patent Application, First Publication No. S48-39338 and Japanese Examined Patent Application, Second Publication No. S53-28375) containing colloidal silica and phosphates (for example, magnesium phosphate, and aluminum phosphate) as primary components or a coating liquid obtained by mixing alumina sol with a boric acid (for example, refer to Japanese Unexamined Patent Application, First Publication No. H06-65754 and Japanese Unexamined Patent Application, First Publication No. H06-65755). In this embodiment, the insulating coating 13 is formed of aluminum phosphate, colloidal silica, chromic anhydride, and the like (for example, refer to Japanese Examined Patent Application, Second Publication No. S53-28375). In addition, the thickness of the insulating coating 13 is, for example, generally about 2 μm, but is not limited to this example.

In the grain-oriented electrical steel sheet 10 according to this embodiment, which is manufactured by the above-described method, the laser irradiation mark 14 is formed in the region in which the laser processed portion 20 is formed in the laser processing process S06. The laser irradiation mark 14 is formed on one side surface or both side surfaces of the grain-oriented electrical steel sheet 10.

The laser irradiation mark 14 can be recognized as a portion having a different color from the other portions when the surface of the grain-oriented electrical steel sheet 10 is visually observed. It is thought that this is because there is a difference in the composition ratio of elements such as Mg or Fe in the glass coating 12 or in the thickness of the glass coating 12. Therefore, the laser irradiation mark 14 can be specified through an element analysis of the glass coating 12. For example, according to an electron probe micro analyzer (EPMA) analysis of the glass coating 12, in the laser irradiation mark 14, changes such as a reduction in the intensity of the characteristic X-ray of Mg or an increase in the intensity of the characteristic X-ray of Fe may be recognized.

The laser irradiation mark 14 is generated by the alteration of the laser processed portion 20 formed by the above-described laser irradiation method, through the finish annealing process S08. The laser irradiation mark 14 is formed on the inside separated from one end of the grain-oriented electrical steel sheet 10 in the width direction by a predetermined distance WL, in a line shape along the rolling direction (the longitudinal direction of the steel sheet 11). In the example of FIG. 5, the laser irradiation mark 14 is formed in a continuous straight line shape along the rolling direction. However, the laser irradiation mark 14 is not limited to this example, and may be formed in a discontinuous straight line shape, for example, in a broken line shape that is periodically broken, along the rolling direction.

Otherwise, the laser irradiation mark 14 may be partially formed in a portion of the steel sheet 11 in the longitudinal direction (rolling direction). In this case, it is preferable that the laser irradiation mark 14 is formed in a region of the steel sheet 11 which is 20% to 100% of the entire length of the steel sheet 11 in the longitudinal direction from the starting point which is the outermost circumferential portion of the coil 5 obtained by coiling the steel sheet 11. That is, it is preferable that the longitudinal direction length Lz of the laser irradiation mark 14 from the leading end of the grain-oriented electrical steel sheet 10 in the longitudinal direction is 20% or greater of the entire length Lc of the grain-oriented electrical steel sheet 10 ($Lz \geq 0.2 \times Lc$).

The outer circumferential side portion of the coil 5 reaches a high temperature during the finish annealing, and thus the side strain deformation easily occurs in the outer circumferential side portion. Therefore, it is preferable that the laser irradiation mark 14 is formed in a region which is 20% or greater of the entire length Lc of the coil 5 from the starting point which is the outermost circumferential portion of the coil 5. Accordingly, in the finish annealing process S08, the laser irradiation mark 14 formed in the outer circumferential side portion of the coil 5 is locally deformed, and thus the propagation of the side strain deformation in the outer circumferential side portion of the coil 5 can be reliably suppressed. On the other hand, in a case where the formation range of the laser irradiation mark 14 is less than 20% of the entire length Lc of the coil 5, the laser irradiation mark 14 having a sufficient length is not formed in the outer circumferential side portion of the coil 5, and thus the effect of suppressing the side strain deformation in the outer circumferential side portion of the coil 5 is reduced.

In addition, in order to further reliably suppress the propagation of the side strain deformation, the laser irradiation mark 14 may be formed over the entire length of the steel sheet 11 in the longitudinal direction (rolling direction) ($Lz=Lc$).

In addition, the laser irradiation mark 14 is formed at a position at which the distance WL from one end of the grain-oriented electrical steel sheet 10 in the width direction to the center of the laser irradiation mark 14 in the width direction is 5 mm to 35 mm ($5\ mm \leq WL \leq 35\ mm$). Furthermore, it is preferable that the width d of the laser irradiation mark 14 is 0.05 mm to 5.0 mm ($0.05\ mm \leq d \leq 5.0\ mm$).

As described above, since the laser irradiation mark 14 is formed at the position where the condition of $5\ mm \leq WL \leq 35\ mm$ is satisfied, the laser irradiation mark 14 which is easily deformed in the finish annealing process S08 can be consequently formed at a position where the side strain deformation can be suppressed, and thus the side strain width Wg of the side strain portion 5*e* can be reliably reduced.

In addition, in this embodiment, in the base iron portion of a portion positioned at the lower portion of the laser irradiation mark 14 in the base iron portion of the steel sheet 11, the average value R of the angular deviation amounts θa between the directions of the magnetization easy axes of the grains and the rolling direction is higher than 20° and equal to or less than 40°, preferably, higher than 20° and equal to or less than 30°. Here, the average value R of the angular deviation amounts θa can be obtained regarding the grains (that is, the grains in the region of the melted-resolidified portion 22) positioned at the lower portion of the laser irradiation mark 14 formed on the surface of the steel sheet 11, by defining the angular deviation amount θa between the direction of the magnetization easy axis of each of the grains and the rolling direction of the steel sheet 11 and averaging the angular deviation amounts θa of the grains by the grains positioned at the lower portion of the laser irradiation mark 14.

In this embodiment, the angular deviation amount θa between the direction of the magnetization easy axis of the grain and the rolling direction is defined as follows. That is, the square mean value of an angle θt by which the direction of the magnetization easy axis of the grain as an object rotates around the width direction axis of the steel sheet 11 from the rolling direction in the steel sheet surface as the reference and an angle θn by which the direction of the magnetization easy axis of the grain rotates around an axis perpendicular to the steel sheet surface from the rolling direction in the steel sheet surface as the reference is defined as the angular deviation amount θa ($\theta a=(\theta t^2+\theta n^2)^{0.5}$). Here, θt and θn are measured by a grain orientation measurement method (Laue method) using X-ray diffraction. An increase in θa means a grain in which the magnetization easy axis is further deviated from the rolling direction of the steel sheet 11. When the magnetization easy axis of the grain is significantly deviated from the rolling direction, the magnetization direction of the corresponding portion is easily directed in a direction significantly different from the rolling direction, and thus it is difficult for the lines of magnetic force to be transmitted in the rolling direction. As a result, magnetic properties of the steel sheet 11 with respect to the rolling direction are deteriorated.

Figure 14:
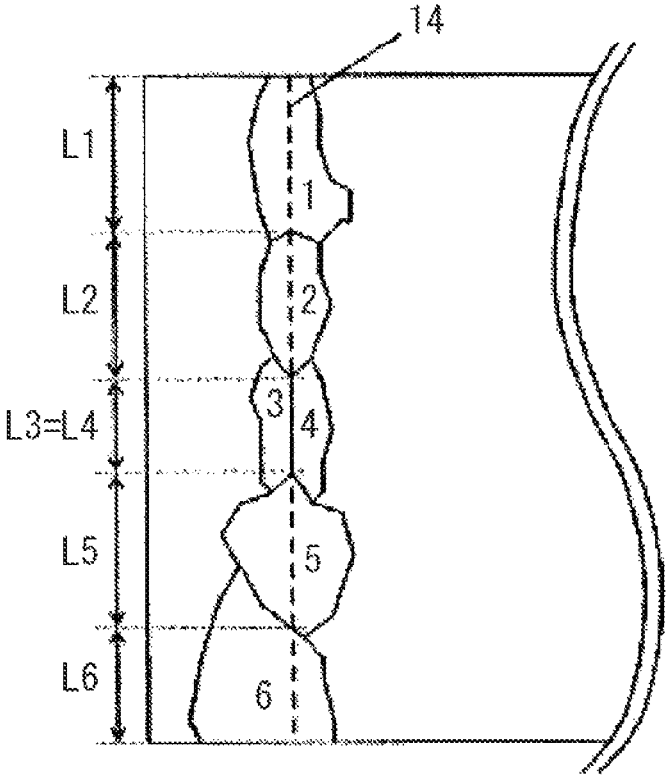
FIG. 14 is an explanatory view showing grains generated in the vicinity of a laser irradiation mark in the surface of a base iron portion of the steel sheet.

In addition, in this embodiment, as shown in FIG. 14, regarding the grains generated in the base iron portion (a portion corresponding to the laser processed portion 20 and the melted-resolidified portion 22) at the lower portion of the laser irradiation mark 14 formed along the rolling direction of the grain-oriented electrical steel sheet 10, the average value R of the angular deviation amounts θa is defined by the following expression (6).

[Formula 2]

$$R = \frac{\sum_i w_i \cdot L_i \cdot \theta a_i}{\sum_i w_i \cdot L_i} \tag{6}$$

Here, i represents the number of the grain. In the example of FIG. 14, six grains (i=1 to 6) are present at the lower portion of the laser irradiation mark 14. As shown in FIG. 14, when the steel sheet 11 is viewed from the surface side, $L_i$ is the distance by which the laser irradiation mark 14 and the i-th grain overlap or come into contact with each other. $\theta a_i$ relates to the i-th grain, and is the angle θa of rotation defined as described above. In addition, as in the grains other than the third and fourth grains in FIG. 14, when the grain straddles both sides of the laser irradiation mark 14, $w_i$ is set to "1". On the other hand, as in the third and fourth grains in FIG. 14, in a case where the laser irradiation mark 14 exactly corresponds to the grain boundary between the two grains, $w_i$ is set to "0.5".

As described in the following examples, when the melted-resolidified portion 22 is formed in the base iron portion to a degree at which the irradiated laser beam penetrates through the sheet thickness in the laser processing process S06, the effect on the grain growth of the steel sheet 11 during the finish annealing is increased. As a result, the average value R of the angular deviation amounts θa is increased, and thus there is a tendency for the magnetic properties of the grain-oriented electrical steel sheet 10 in the rolling direction to be deteriorated. On the other hand, in this embodiment, since the laser irradiation conditions are set such that the depth D of the melted-resolidified portion 22 is greater than 0% and equal to or less than 80% of the sheet thickness t, the melted-resolidified portion 22 formed in the steel sheet 11 does not penetrate the steel sheet 11 in the direction of the sheet thickness. Accordingly, the average value R of the angular deviation amounts θa is in a range of higher than 20° and equal to or less 40°, and thus the grain-oriented electrical steel sheet 10 in which the deterioration of magnetic properties is suppressed (that is, the grain-oriented electrical steel sheet 10 having excellent magnetic properties) can be obtained.

In the grain-oriented electrical steel sheet 10 according to this embodiment, there may be a case where the side strain width Wg of the side strain portion **5*e* is small and thus the side strain portion 5*e* does not need to be removed. At this time, in a portion (base iron) positioned at the lower portion of the laser irradiation mark 14 in the steel sheet 11, the average value R of the angular deviation amounts θa is higher than 20° and equal to or less 40°. Therefore, the grain orientations of the width direction side end portion of the steel sheet 11 including the base iron portion at the lower portion of the laser irradiation mark 14 are highly stabilized compared to in the related art, and thus it is possible to use the grain-oriented electrical steel sheet 10** as it is without trimming off the side end portion depending on usage.

While the grain-oriented electrical steel sheet 10 according to the embodiment of the present invention and the method of manufacturing the grain-oriented electrical steel sheet 10 have been described above, the present invention is not limited thereto. It is apparent that various changes and modifications can be made by those skilled in the art to which the present invention belongs without departing from the technical spirit described in the appended claims, and it is understood that these naturally belong to the technical scope of the present invention.

For example, the composition of the steel sheet 11 is not limited to the above description of the embodiment, and may be another composition. In addition, in the above-described embodiment, the example in which the laser processing process S06 is provided between the decarburizing annealing process S05 and the annealing separator applying process S07 is described. However, the laser processing may be performed between any of the processes after the cold rolling process S04 and before the finish annealing process S08.

In addition, in the above-described embodiment, the decarburizing annealing process S05, the laser processing process S06, and the annealing separator applying process S07 are performed by the devices shown in FIGS. 7 and 8. However, the processes are not limited thereto and may be performed by devices having different structures.

Figure 13:
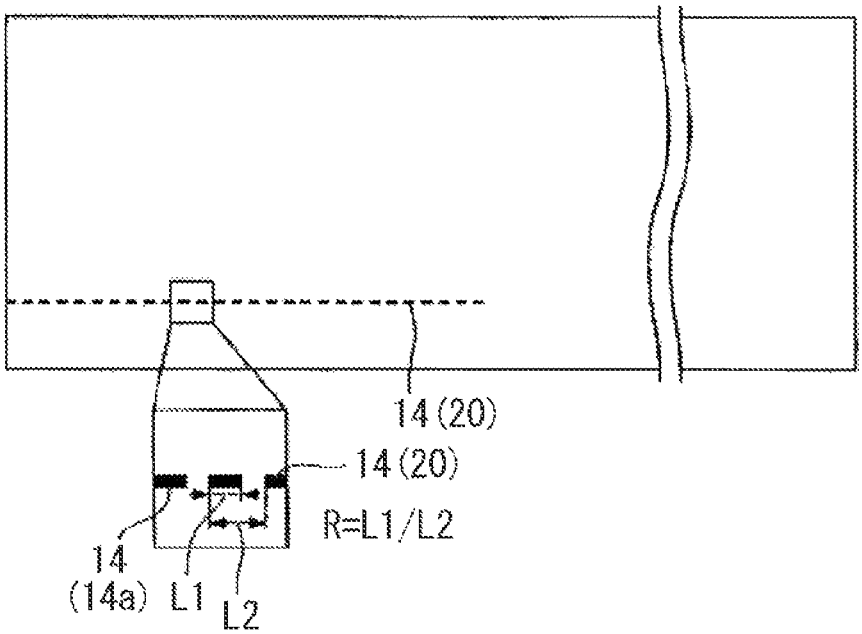
FIG. 13 is an explanatory view showing a grain-oriented electrical steel sheet according to another embodiment of the present invention.

Furthermore, in the above-described embodiment, as shown in FIG. 5, the example in which the laser irradiation mark 14 is formed in a continuous straight line shape along the rolling direction is described, but the shape is not limited thereto. The laser irradiation mark 14 (the laser processed portion 20) may be formed in a discontinuous broken line shape, and for example, as shown in FIG. 13, the laser irradiation mark 14 (the laser processed portion 20) may be periodically formed along the rolling direction. In this case, an effect of reducing the average laser power can be obtained. In a case of periodically forming the laser processed portion 20, the ratio r of the laser processed portion 20 per each period is not particularly limited as long as the effect of suppressing the side strain deformation can be obtained, and for example, r>50% is preferable.

In addition, in the above-described embodiment, in the laser processing process S06, a case where the laser beam is irradiated along the rolling direction of the steel sheet 11 so that the melted-resolidified portion 22 having a depth D of greater than 0% and equal to or less than 80% of the sheet thickness t of the steel sheet 11 is formed at the position corresponding to the laser processed portion 20, is an exemplary example. Here, in the laser processing process S06, it is more preferable that the laser beam is irradiated along the rolling direction of the steel sheet 11 so that the melted-resolidified portion 22 having a depth D of greater than 16% and equal to or less than 80% of the sheet thickness t of the steel sheet 11 is formed at the position corresponding to the laser processed portion 20.

In this case, in a grain-oriented electrical steel sheet 10 which is lastly obtained, the average value R of the angular deviation amounts θa between the directions of the magnetization easy axes of the grains which are present at the lower portion of the laser irradiation mark 14 formed on the surface of the base iron (the steel sheet 11) and the rolling direction is higher than 25° and equal to or less than 40°.

In addition, the laser irradiation marks 14 (the laser processed portion 20) may be formed on both surfaces of the grain-oriented electrical steel sheet 10 by irradiating both surfaces of the steel sheet 11 with the laser beam.

That is, both the surfaces of the steel sheet 11 may be irradiated with the laser beam so that the laser irradiation mark 14 formed on one surface of the steel sheet 11 and the laser irradiation mark 14 formed on the other surface of the steel sheet 11 overlap each other in the plan view of the steel sheet 11.

Figure 18:
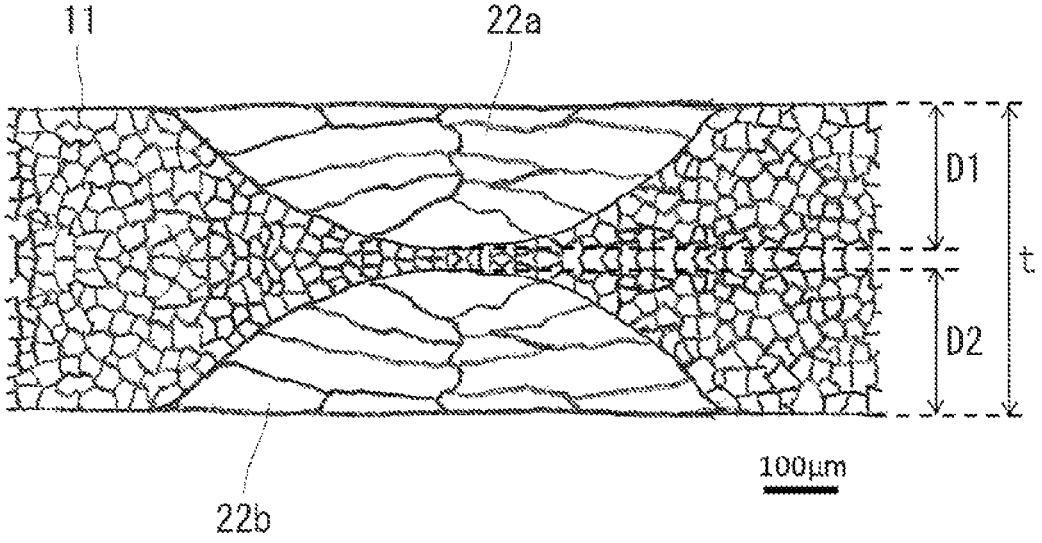
FIG. 18 is a schematic view showing a case where both surfaces of the steel sheet 11 are irradiated with a laser beam so that a first melted-resolidified portion 22*a* having a depth D1 is formed from one surface of the steel sheet 11 and a second melted-resolidified portion 22*b* having a depth D2 is formed from the other surface of the steel sheet 11.

In this case, for example, as shown in FIG. 18, the irradiation condition of the laser beam is set such that a first melted-resolidified portion 22*a* having a depth D1 is formed from one surface of the steel sheet 11 and a second melted-resolidified portion 22*b* having a depth D2 is formed from the other surface of the steel sheet 11. The sum D (=D1+D2) of the depth D1 of the first melted-resolidified portion 22*a* and the depth D2 of the second melted-resolidified portion 22*b* may be higher than 0% and equal to or less than 80% (more preferably, higher than 16% and equal to or less than 80%) of the sheet thickness t of the steel sheet 11.

Otherwise, both the surfaces of the steel sheet 11 may be irradiated with the laser beam so that the laser irradiation mark 14 formed on one surface of the steel sheet 11 and the laser irradiation mark 14 formed on the other surface of the steel sheet 11 do not overlap each other in the plan view of the steel sheet 11.

In this case, at least one of the depth D1 of the first melted-resolidified portion 22*a* formed on one surface of the steel sheet 11 by the laser irradiation and the depth D2 of the second melted-resolidified portion 22*b* formed on the other surface of the steel sheet 11 by the laser irradiation may be greater than 0% and equal to or less than 80% (more preferably, greater than 16% and equal to or less t80%) of the sheet thickness t of the steel sheet 11.

EXAMPLES

Next, a confirmation experiment conducted to confirm the effect of the present invention will be described.

First, a slab which has a composition including: Si: 3.0 mass %; C: 0.05 mass %; Mn: 0.1 mass %; acid-soluble Al: 0.02 mass %; N: 0.01 mass %; S: 0.01 mass %; P: 0.02 mass %; and the remainder including Fe and an impurity was cast (casting process S01).

Hot rolling was performed on the slab at 1280° C., thereby producing a hot-rolled material having a thickness of 2.3 mm (hot rolling process S02).

Next, the hot-rolled material was annealed by performing a heat treatment on the hot-rolled material under the condition of 1000° C. for 1 minute (annealing process S03). A pickling treatment was performed on the hot-rolled material after the annealing process and cold rolling was performed thereon, thereby producing cold-rolled materials having thicknesses of 0.23 mm and 0.35 mm (cold rolling process S04).

Decarburizing annealing was performed on the cold-rolled material under the condition of 800° C. for 2 minutes (decarburizing annealing process S05). The $SiO_2$ coatings 12*a* were formed on both surfaces of the steel sheet 11, which was the cold-rolled material, through the decarburizing annealing process.

Subsequently, the surface of the steel sheet 11 in which the Si(coating 12*a* was formed on the surface thereof was irradiated with a laser by the laser processing device, thereby forming the laser processed portion 20 (laser processing process S06).

Next, the annealing separator containing magnesia as a primary component was applied to both the surfaces of the steel sheet 11 in which the laser processed portion 20 was formed on the $SiO_2$ coating 12*a* (annealing separator applying process S07).

In addition, the steel sheet 11 to which the annealing separator was applied was loaded into a batch type finish annealing furnace in a state of being coiled in a coil shape, and was then subjected to finish annealing under the condition of 1200° C. for 20 hours (finish annealing process S08).

Here, by variously changing the conditions when the laser processed portion 20 was formed in the laser processing process S06, the relationship between the conditions, the side strain width Wg after the finish annealing, and the average value R of the angular deviation amounts θa between the directions of the magnetization easy axes of the grains in the portion positioned at the lower portion of the laser irradiation mark 14 in the steel sheet 11 and the rolling direction was evaluated.

A semiconductor laser was used as a laser device. The laser processing and the evaluation were performed by variously changing the sheet threading speed VL (mm/sec) of the steel sheet 11, the sheet thickness t (mm) of the steel sheet 11, the power P (W) of the laser beam, the laser beam diameter dc (mm) of the steel sheet 11 in the width direction, and the laser beam diameter dL (mm) of the steel sheet 11 in the sheet travelling direction (longitudinal direction). The flow rate of the assist gas was fixed to Gf=300 (L/min) and the irradiation position of the steel sheet 11 in the width direction irradiated with the laser beam was fixed to WL=18 (mm). In addition, the rolling direction length of the laser processed portion 20 from the starting point which is the outermost circumferential portion of the coil was set to Lz=2500 m (the entire length Lc of the coil was 10,000 m).

The conditions of the laser beam and the data of the evaluation results are collected in Table 1.

Table 1 shows the value of (P−P1)/(P2−P1) calculated by using the above expressions (3) to (5) and the ratio q (=D/t) of the depth D of the melted-resolidified portion 22, which was obtained by polishing the cross-section of the steel sheet 11 immediately after the laser processing and then performing measurement using an optical microscope, to the sheet thickness t of the steel sheet 11. In addition, the side strain width Wg shown in Table 1 is the maximum value with respect to the entire length of the coil. In addition, the side strain width Wg in a case where the laser processing was not performed was 45 mm.

In addition. Table 1 shows the value obtained by measuring the directions of the magnetization easy axes of the grains in the base iron portion positioned in the laser processed portion 20 in the steel sheet 11 using X-ray diffraction and calculating the average value R of the angular deviation amounts θa between the directions of the magnetization easy axes and the rolling direction is shown.

Furthermore, the result of evaluating iron loss W17/50 by a single sheet tester (SST) test is shown. As the test piece for the SST measurement, a quadrangular piece which was cut from a region (region including the laser irradiation mark 14) having a width of 100 mm from one end (edge) of the steel sheet 11 into a size of a steel sheet width direction length of 100 mm and a steel sheet rolling direction length of 500 mm was used. An iron loss deterioration ratio (%) was defined with respect to the iron loss of a portion of the steel sheet 11 of the same coil where the laser processing was not performed, as the reference.

In addition, from the data of the iron loss deterioration ratio shown in Table 1, it can be seen that when the average value R of the angular deviation amounts θa is 40° or less, the iron loss deterioration ratio can be suppressed to be less than 10%. Reducing the side strain width Wg by 20 mm means an increase in yield by about 2% in the manufacture of the grain-oriented electrical steel sheet having a coil width of about 1000 mm. According to the trial calculation by the inventors, when the yield is increased by less than 2%, the cost of the laser processing calculated as the cost of an operation and maintenance of a laser irradiation facility is higher than a reduction in manufacturing cost due to the enhancement of the yield. However, when the yield is increased by 2% or more, the introduction of the laser irradiation facility has an advantage and thus the effect of the present invention can be exhibited. Furthermore, in the grain-oriented electrical steel sheet 10 manufactured by the method of the present invention, the iron loss deterioration ratio of the side strain portion 5*e* is suppressed to be less than 10%, and the side strain width Wg is small. Theretofore, the side strain deformation itself is suppressed. Accordingly, in a case where the side strain portion 5*e* is allowed while being included, the side strain portion 5*e* can be used without being trimmed off. In this case, the yield of the grain-oriented electrical steel sheet 10 can be further enhanced.

As the ratio q is increased, the average value R of the angular deviation amounts θa and the iron loss deterioration ratio are increased. The iron loss deterioration ratio is less than 10% when the average value R of the angular deviation amounts θa is 40° or less, and the iron loss deterioration ratio is suppressed to be 6% or less when the average value R of the angular deviation amounts θa is 30° or less. An iron loss deterioration ratio of less than 10% means that there is a

TABLE 1

| | t (mm) | dc (mm) | dL (mm) | VL (mm/s) | P (W) | (P − P1)/(P2 − P1) | q | Wg (mm) | R | Iron loss deterioration ratio (%) |
|---|---|---|---|---|---|---|---|---|---|---|
| Comparative Example 1 | 0.23 | 2 | 12 | 400 | 2850 | 1.25 | 0.94 | 18 | 48 | 12 |
| Invention Example 1 | 0.23 | 1.5 | 12 | 400 | 2565 | 1.00 | 0.8 | 19 | 40 | 9.5 |
| Invention Example 2 | 0.23 | 1 | 12 | 400 | 2160 | 0.75 | 0.63 | 20 | 35 | 9.5 |
| Invention Example 3 | 0.23 | 1 | 12 | 800 | 3800 | 0.92 | 0.71 | 19 | 36 | 8.3 |
| Comparative Example 2 | 0.35 | 2 | 12 | 400 | 2750 | −0.05 | 0 | 29 | 18 | 2.4 |
| Invention Example 4 | 0.35 | 1.4 | 12 | 400 | 2225 | 0.00 | 0.02 | 25 | 21 | 4.8 |
| Invention Example 5 | 0.35 | 1.2 | 12 | 400 | 2400 | 0.23 | 0.16 | 22 | 25 | 6 |
| Invention Example 6 | 0.35 | 1 | 12 | 400 | 1900 | 0.04 | 0.05 | 24 | 22 | 4.8 |
| Invention Example 7 | 0.35 | 1.4 | 12 | 600 | 3360 | 0.29 | 0.23 | 22 | 27 | 4.8 |
| Invention Example 8 | 0.35 | 1 | 12 | 600 | 3020 | 0.36 | 0.31 | 21 | 30 | 6 |
| Invention Example 9 | 0.35 | 0.7 | 12 | 600 | 3310 | 0.62 | 0.52 | 19 | 34 | 9.3 |
| Invention Example 10 | 0.35 | 1 | 12 | 800 | 3980 | 0.46 | 0.34 | 20 | 32 | 7.1 |

Figure 15:
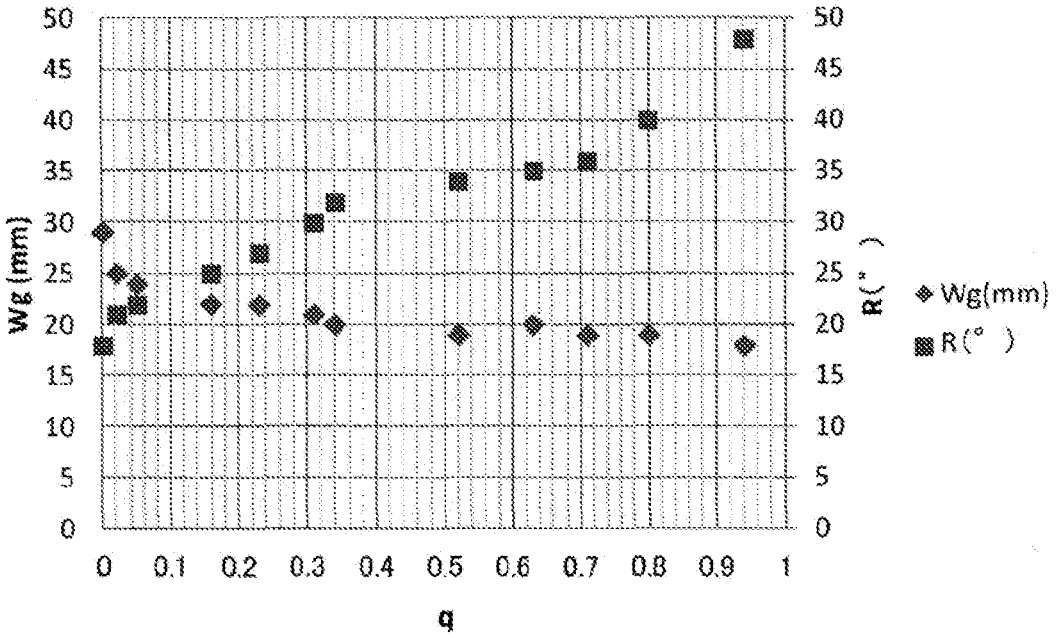
FIG. 15 is a graph showing the relationship between the average value R of angular deviation amounts θa between the directions of the magnetization easy axes of the grains and a rolling direction, a parameter q, and a side strain width Wg.

FIG. 15 illustrates the relationship between the ratio q, the side strain width Wg, and the average value R of the angular deviation amounts θa, which are shown in Table 1. As can be seen from FIG. 15, when q>0 as in Invention Examples (Examples) 1 to 10, the side strain width Wg is equal to or less than 25 mm, and is thus less than the side strain width of Wg=45 mm in the case where the laser processing is not performed by 20 mm or more. In addition, when 0<q≤0.8, 20°<R≤40° is satisfied. Therefore, when the ratio q is 0 to 0.8, the side strain width Wg can be reduced by 20 mm or more, and the average value R of the angular deviation amounts θa can be included in a range of higher than 20° and equal to or less 40°.

possibility that the degradation in the product grade of the grain-oriented electrical steel sheet 10 may be suppressed by one grade or less. Therefore, when R≤400, depending on the usage, there is a high possibility that the end portion of the grain-oriented electrical steel sheet 10 in the width direction including the laser irradiation mark 14 formed by the laser processing may not be trimmed off and may be used as a product having the same grade as that of the portion of the inside of the grain-oriented electrical steel sheet 10. Accordingly, there is an effect of increasing the yield of the grain-oriented electrical steel sheet 10.

On the other hand. Comparative Example 1 is an example in which the ratio q exceeds 0.8 due to an excessive laser power P with respect to the sheet threading speed VL, and thus the average value R of the angular deviation amounts θa is higher than 40° and the iron loss deterioration ratio is 10% or higher. In addition, Comparative Example 2 is an example in which the ratio q is 0 due to the insufficiency of the laser power P with respect to the laser beam diameter dc and thus the side strain width Wg is increased to 29 mm and the reduction amount of the side strain width Wg is less than 20 mm.

As described above, it can be seen that the range of the ratio q may be $0<q\leq0.8$ in order to reduce the side strain width Wg by 20 mm or more and suppress the iron loss deterioration ratio to be less than 10%.

Furthermore, according to the comparison between Comparative Example 1, Invention Example 1, and the like, it can be seen that the iron loss deterioration ratio can be suppressed to be less than 10% by setting the average value R of the angular deviation amounts θa between the directions of the magnetization easy axes of the grains of the steel sheet 11 and the rolling direction to be 40° or less. In addition, according to the comparison between Comparative Example 2. Invention Example 4, and the like, it can be seen that the side strain width Wg can be reduced by 20 mm or more by setting the average value R of the angular deviation amounts θa to be higher than 20°, particularly, to be equal to or higher than 21°, compared to the case where the laser processing is not performed.

Therefore, it can be seen that the range of the average value R of the angular deviation amounts θa may be $20°<R\leq40°$ at a position corresponding to the laser irradiation mark 14 of the grain-oriented electrical steel sheet 10 in order to reduce the side strain width Wg by 20 mm or more and suppress the iron loss deterioration ratio to be less than 10%.

In addition, regarding the value of (P−P1)/(P2−P1) shown in Table 1, it can be seen that when $0\leq(P-P1)/(P2-P1)\leq1.0$, the penetration depth (that is, the ratio q of the depth D of the melted-resolidified portion to the sheet thickness t of the steel sheet 11) of the melted-resolidified portion 22 can be in a rage of $0<q\leq0.8$.

Figure 16:
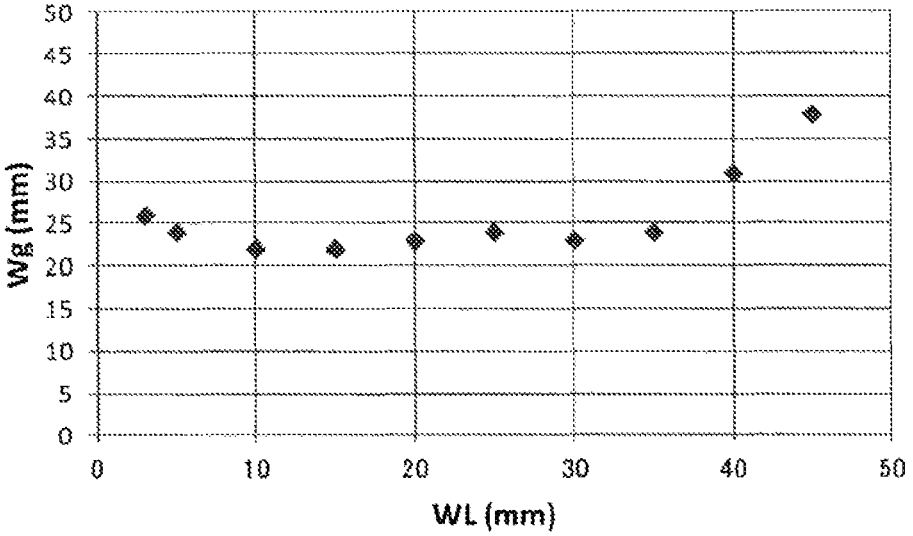
FIG. 16 is a graph showing the relationship between the distance WL from an end portion of the steel sheet in the width direction to a laser processed portion, and the side strain width Wg.

In addition, the relationship between the distance WL from one end of the steel sheet 11 in the width direction to the center of the laser processed portion 20 (laser irradiation mark 14) in the width direction, and the side strain width Wg is shown in FIG. 16. In addition, the rolling direction length Lz of the laser processed portion 20 (laser irradiation mark 14) was set to be 2500 m (the entire length Lc of the coil of 10,000 m). The laser condition was set to the condition corresponding to Invention Example 5.

As shown in FIG. 16, it was confirmed that when the distance WL is 40 mm or longer, the side strain width Wg is increased to be greater than 25 mm and the reduction amount of the side strain width Wg is less than 20 mm, and thus the effect of suppressing the side strain width Wg is reduced. Contrary to this, it can be seen that when the distance WL is 5 mm to 35 mm, the side strain width Wg is 25 mm or less, and thus the side strain width Wg can be appropriately suppressed. In addition, when the distance WL is less than 5.0 mm, the side strain width Wg has a tendency to be slightly increased, and thus it is preferable that the distance WL is 5.0 mm or more. From the above description, it is preferable that the distance WL from one side end of the steel sheet 11 to the center of the laser processed portion 20 (laser irradiation mark 14) in the width direction is 5 mm to 35 mm.

Figure 17:
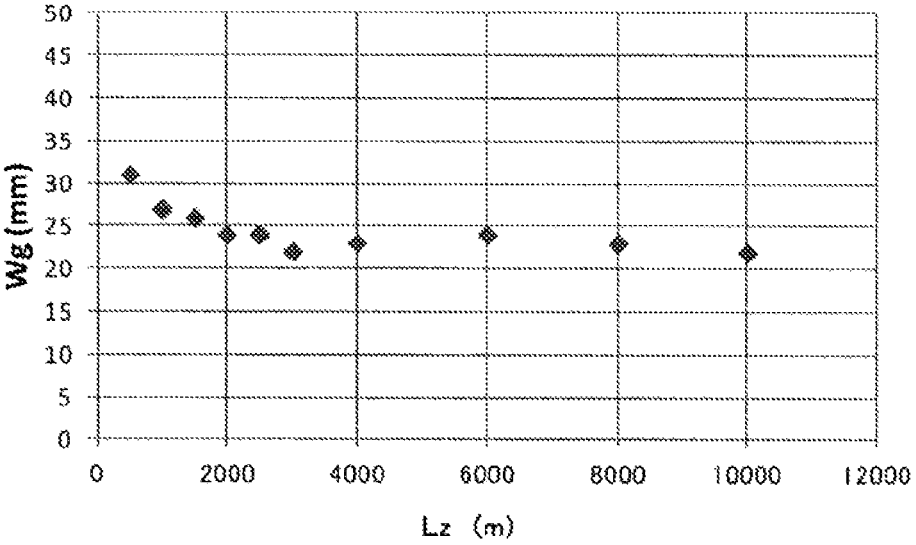
FIG. 17 is a graph showing the relationship between the rolling direction length Lz of the laser processed portion and the side strain width Wg.

Furthermore, in a case where the entire length Lc of the steel sheet is 10,000 m, when the rolling direction length Lz of the laser processed portion 20 (laser irradiation mark 14) from the starting point which is the outermost circumferential portion of the coil 5 is changed, the relationship between the rolling direction length Lz and the side strain width Wg is shown in FIG. 17. In addition, the starting point of the rolling direction length Lz of the laser processed portion 20 is the outermost circumferential portion of the coil 5. The laser condition was set to the condition corresponding to Invention Example 5. The distance WL was set to 20 mm. The side strain width Wg shown in FIG. 17 is the maximum value with respect to the entire length of the coil.

As shown in FIG. 17, in a case where the rolling direction length Lz of the laser processed portion 20 is 500 m to 1500 mm (5 to 15% of the entire length Lc of the steel sheet), the side strain width Wg is increased to be greater than 25 mm and the reduction amount of the side strain width Wg is less than 20 mm, and thus the effect of suppressing the side strain width Wg is reduced. Contrary to this, in a case where the rolling direction length Lz of the laser processed portion 20 is 2000 m or longer, that is, 20% or more of the entire length Lc of the steel sheet, the side strain width Wg is less than 25 mm and the reduction amount of the side strain width Wg is 20 mm or more, and thus the side strain width Wg can be appropriately suppressed. Accordingly, it is preferable that the laser processed portion 20 is formed in the region of the steel sheet 11 which is 20% or more of the entire length Lc in the rolling direction from the outer circumference of the coil 5 where the side strain deformation is significant.

BRIEF DESCRIPTION OF THE REFERENCE SYMBOLS

5: COIL
5*e*: SIDE STRAIN PORTION
10: GRAIN-ORIENTED ELECTRICAL STEEL SHEET
11: STEEL SHEET
12: GLASS COATING
12*a*: $SiO_2$ COATING
13: INSULATING COATING
14: LASER IRRADIATION MARK
20: LASER PROCESSED PORTION
22: MELTED-RESOLIDIFIED PORTION

The invention claimed is:

1. A grain-oriented electrical steel sheet which is manufactured by irradiating a region on one end side of a steel sheet in a width direction after being subjected to a cold rolling process with a laser beam along a rolling direction of the steel sheet and thereafter performing a finish annealing on the steel sheet which is coiled in a coil shape, wherein, regarding grains in the region of a melted-resolidified portion in a base iron portion of the steel sheet, which are positioned at a lower portion of a laser irradiation mark formed on a surface of the steel sheet by the irradiation of the laser beam, an angular deviation amount θa between a direction of a magnetization easy axis of each of the grains and the rolling direction is defined, and an average value R of the angular deviation amounts θa obtained by averaging the angular deviation amounts θa of the grains by the grains positioned at the lower portion of the laser irradiation mark is higher than 20° and equal to or less 40°.

2. The grain-oriented electrical steel sheet according to claim 1, wherein a distance WL from one end of the steel sheet in the width direction to a center of the laser irradiation mark in the width direction is 5 mm to 35 mm.

3. The grain-oriented electrical steel sheet according to claim 1, wherein the laser irradiation mark is formed in a region of 20% to 100% of an entire length of the steel sheet in the rolling direction from a starting point which is one end of the steel sheet in the rolling direction positioned in an outermost circumference of the steel sheet coiled in a coil shape.

4. The grain-oriented electrical steel sheet according to claim 1, wherein a width d of the laser irradiation mark is 0.05 mm to 5.0 mm.

5. A method of manufacturing a grain-oriented electrical steel sheet, comprising:

a laser processing process of forming a laser processed portion by irradiating a region on one end side of a steel sheet in a width direction after being subjected to a cold rolling process with a laser beam along a rolling direction of the steel sheet; and a finish annealing process of coiling the steel sheet with the laser processed portion formed thereon in a coil shape and performing a finish annealing on the coil-shaped steel sheet, wherein, in the laser processing process, a melted-resolidified portion having a depth of greater than 0% and equal to or less than 80% of a sheet thickness of the steel sheet is formed by the irradiation of the laser beam at a position corresponding to the laser processed portion.

6. The method of manufacturing a grain-oriented electrical steel sheet according to claim 5, wherein a distance WL from one end of the steel sheet in the width direction to a center of the laser processed portion in the width direction is 5 mm to 35 mm.

7. The method of manufacturing a grain-oriented electrical steel sheet according to claim 5, wherein, in the laser processing process, the laser processed portion is formed in a region of 20% to 100% of an entire length of the steel sheet in the rolling direction from a starting point which is one end of the steel sheet in the rolling direction positioned in an outermost circumference of the steel sheet coiled in a coil shape in the finish annealing process.

8. The method of manufacturing a grain-oriented electrical steel sheet according to claim 5, wherein a width d of the laser processed portion is 0.05 mm to 5.0 mm.

9. The grain-oriented electrical steel sheet according to claim 2, wherein the laser irradiation mark is formed in a region of 20% to 100% of an entire length of the steel sheet in the rolling direction from a starting point which is one end of the steel sheet in the rolling direction positioned in an outermost circumference of the steel sheet coiled in a coil shape.

10. The grain-oriented electrical steel sheet according to claim 2, wherein a width d of the laser irradiation mark is 0.05 mm to 5.0 mm.

11. The grain-oriented electrical steel sheet according to claim 3, wherein a width d of the laser irradiation mark is 0.05 mm to 5.0 mm.

12. The grain-oriented electrical steel sheet according to claim 9.

wherein a width d of the laser irradiation mark is 0.05 mm to 5.0 mm.

13. The method of manufacturing a grain-oriented electrical steel sheet according to claim 6, wherein, in the laser processing process, the laser processed portion is formed in a region of 20% to 100% of an entire length of the steel sheet in the rolling direction from a starting point which is one end of the steel sheet in the rolling direction positioned in an outermost circumference of the steel sheet coiled in a coil shape in the finish annealing process.

14. The method of manufacturing a grain-oriented electrical steel sheet according to claim 6, wherein a width d of the laser processed portion is 0.05 mm to 5.0 mm.

15. The method of manufacturing a grain-oriented electrical steel sheet according to claim 7, wherein a width d of the laser processed portion is 0.05 mm to 5.0 mm.

16. The method of manufacturing a grain-oriented electrical steel sheet according to claim 13, wherein a width d of the laser processed portion is 0.05 mm to 5.0 mm.

* * * * *